United States Patent [19]

Makino

[11] Patent Number: 4,709,308

[45] Date of Patent: Nov. 24, 1987

[54] LIGHTING DEVICE FOR AN ELEVATOR

[75] Inventor: Katsumi Makino, Inazawa, Japan

[73] Assignee: Mitsubishi Denki Kabushiki Kaisha, Japan

[21] Appl. No.: 879,956

[22] Filed: Jun. 30, 1986

[30] Foreign Application Priority Data

Jul. 1, 1985 [JP] Japan ..... 60-144289

[51] Int. Cl.[4] ..... F21V 21/00

[52] U.S. Cl. ..... 362/148; 362/260; 362/346; 362/330; 52/28

[58] Field of Search ..... 362/148, 147, 150, 153, 362/293, 297, 301, 346, 355, 341, 343, 311, 326, 235, 244; 52/28, 39

[56] References Cited

U.S. PATENT DOCUMENTS 3,712,980 1/1973 Norton ..... 362/260
4,099,090 7/1978 Corth et al. ..... 313/113 X
4,164,011 8/1979 Sherwood ..... 362/330 X
4,250,537 2/1981 Roegner et al. ..... 362/346 X
4,382,272 5/1983 Quella et al. ..... 362/260 X

*Primary Examiner*—Larry Jones
*Attorney, Agent, or Firm*—Leydig, Voit & Mayer

[57] ABSTRACT

A lighting device for an elevator car including light sources for emitting light toward the interior of the elevator car and a spectral resolution filter spaced apart and facing the light sources for spectrally resolving the light emitted from the light sources into spectral light with varying colors. The light sources may take the form of a combination of a mirror ball with reflecting surfaces on its outer periphery and a light projector or the form of a plurality of point light sources mounted in a dispersed pattern. The spectral resolution filter may take the form of a flat half mirror surface of a semisphere.

7 Claims, 9 Drawing Figures

LIGHTING DEVICE FOR AN ELEVATOR

BACKGROUND OF THE INVENTION

1. Field of the Invention

This invention relates to a lighting device for an elevator adapted to be installed in an elevator car.

2. Description of the Prior Art

In general, passengers in an elevator car often feel uneasy or stifled due to the close quarters of the car which is in fact a narrow and closed chamber. In particular, such uneasy feelings will be amplified by the discomfort of standing for a long time in an elevator installed in one of the super-multistory buildings or of travelling for a relatively long duration, or of being in an elevator car full of passengers. It is, therefore, highly desirable to improve such situations.

On the ceiling of an elevator car which has the greatest influence on the feeling of closeness of the car, however, a simple lighting device alone has hitherto been installed.

Now, the construction of such a conventional lighting device will be described with reference to FIG. 7. An elevator car 1 has a ceiling panel 2 to which a lighting panel 3 is attached. A plurality of light sources 4 such as, for example, small electric lamps, fluorescent lamps or the like are mounted on the lighting panel 3 at locations uniformly distributed thereover so that light beams emitted from the respective light sources 4 are led into the interior of the car 1 through a filter 6, such as a transparent panel filter, a half-mirror panel filter or a colored panel filter, mounted on a ceiling decorative frame 5 so as to illuminate the interior space in the car 1. In this case, the light intensity of the light sources 4 is generally determined such that a predetermined illuminance is obtained in the car 1. In other words, the light intensity of the light sources 4 is actually determined from a practical point of view such that passengers in the elevator car 1 can visually discern objects therein.

With the conventional lighting device for an elevator car as constructed in the above manner, light beams emitted from the respective light sources 4 such as small electric lamps pass through the filter 6 so that the brightness and hue of the light sources 4 are reduced. Moreover, the light beams from the light sources 4, being white light or monochromatic light and causing no change in color, are not appealing to passenger's eyes. Under these circumstances, it is desirable to develop a lighting device which can produce an illumination with color variations.

In addition, use of such light sources 4 as electric lamps employing filaments necessarily reduces the area of the light sources and therefore, for the purpose of enabling the entire area of the car ceiling to become effectively illuminated, it is necessary to employ a great number of electric lamps which are arranged in a uniformly dispersed manner over the whole ceiling surface. This results in a problem of high production costs.

SUMMARY OF THE INVENTION

The present invention is intended to obviate the above-mentioned problems of the prior art, and has for its object the provision of an improved lighting device for an elevator which is capable of reducing the unease or discomfort on the part of the passengers in an elevator car, and which can provide an attractive illumination with various color changes in the elevator car, and which is simple in construction and hence low in production costs.

In order to achieve the above objects, according to the present invention, there is provided a lighting device for an elevator car which comprises a plurality of light sources installed in the car, and a spectral resolution filter disposed between the light sources and the interior of the car for spectrally resolving the light beams emitted from the light sources whereby the light beams from the light sources pass through the spectral resolution filter into the car interior for the illumination thereof with varying colors.

In one embodiment, the light sources are mounted on a lighting panel attached to the car, the lighting panel having a mirror surface formed at its one side facing the interior of the car, the spectral resolution filter being disposed in a face-to-face relation with the mirror surface of the lighting panel, the spectral resolution filter having a half mirror panel mounted on its one side surface facing the mirror surface of the lighting panel.

In another embodiment, the light sources comprise a mirror ball having a multitude of reflecting surfaces formed at its outer peripheral surface, and projector means for emitting light beams toward the reflecting surfaces of the mirror ball.

In a further embodiment, the light sources comprise a plurality of point light sources mounted on the ceiling portion of the car so as to be scattered thereover.

In a further embodiment, the spectral resolution filter is in the form of a semispherical configuration in which the light sources are disposed.

The above and other objects, features and advantages of the present invention will become apparent from the following detailed description of several presently preferred embodiments of the invention when taken in conjunction with the accompanying drawings.

DESCRIPTION OF THE PREFERRED EMBODIMENTS

Figure 1:
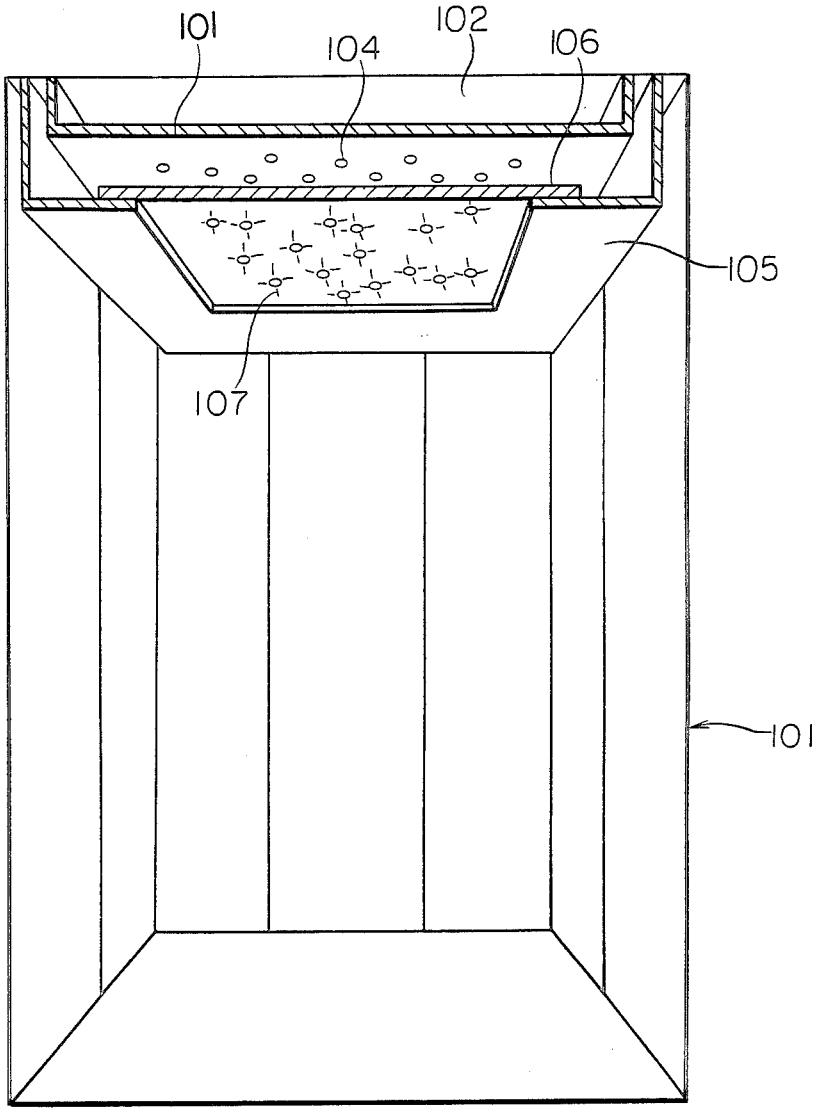
FIG. 1 is a perspective view showing an internal structure of an elevator with a lighting device in accordance with a first embodiment of the present invention.

Now, the present invention will be described in detail with reference to several presently preferred embodiments thereof illustrated in FIGS. 1 through 6 of the accompanying drawings. In the following, the same or corresponding parts of the embodiments of the invention will be identified by the same reference numerals.

Figure 7:
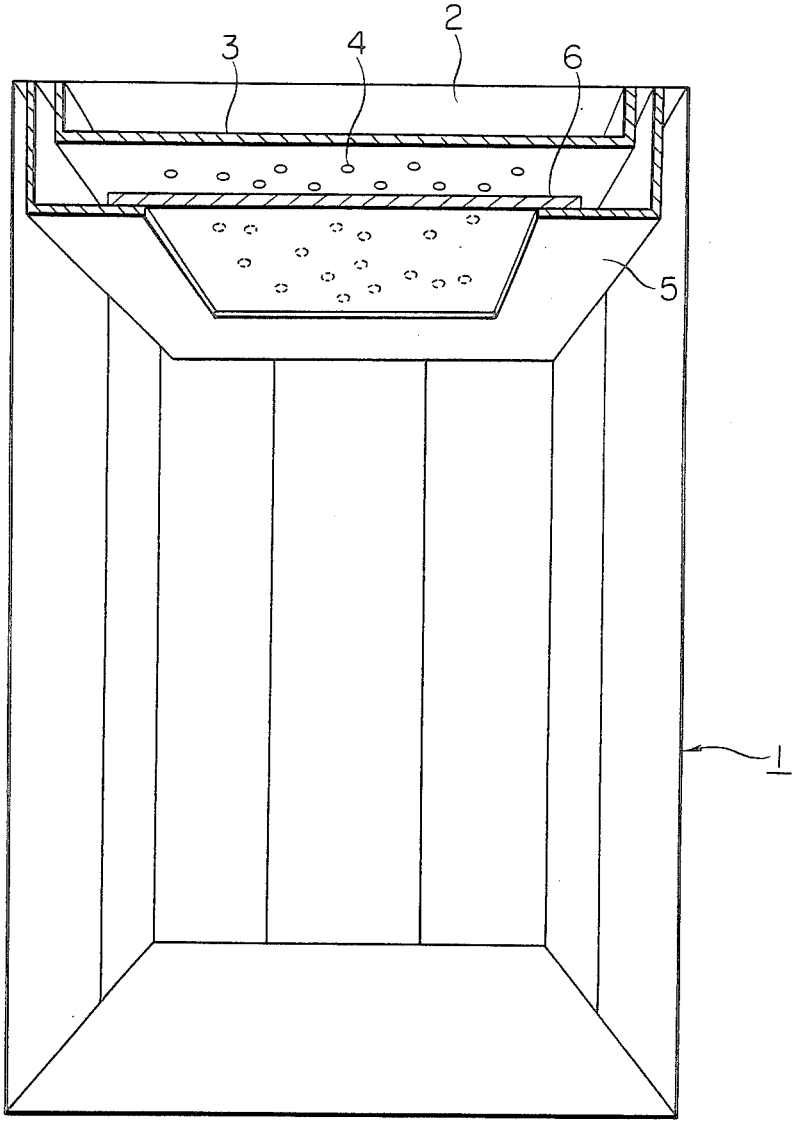
FIG. 7 is a perspective view showing an internal structure of an elevator with a conventional lighting device.

FIG. 1 shows the internal structure of an elevator provided with a lighting device constructed in accordance with a first embodiment of the present invention. In FIG. 1, there is shown an elevator car 101 which includes a ceiling panel 102, a lighting panel 103 mounted on the ceiling panel 102, a plurality of light sources 104, a decorative frame 105 mounted on the ceiling panel 102 so as to cover the lighting panel 103 and having an opening 105*a* formed therethrough for permitting the passage of light beams issued from the light sources 104, and a filter 106 fixedly secured to or just resting on the ceiling decorative frame 105. In this connection, it is to be noted that the construction and arrangement of the above-mentioned members 101 through 105 are the same as those shown in FIG. 7.

According to the present invention, the filter 106 comprises a spectral resolution filter in the form of a panel through which light beams emitted from the light sources 110 pass so as to illuminate the interior of the car 101. When the light beams from the light sources 104 pass through the spectral resolution filter panel 106, they are resolved by the filter panel 106 to form stripes of spectral light on the inner surface of the filter panel 106 facing the interior space in the car 101.

Now, the filter 106 will be described in detail with particular reference to FIGS. 2*a* and 2*b*. The filter 106 illustrated in FIG. 2*a* functions to effect spectral resolution of light by the use of a light diffraction phenomenon. To this end, the spectral resolution filter 106 comprises a light-transmitting panel which is formed of a transparent resin or other transparent material and which is provided at its one side surface with a diffraction grating 106*b* in the form of a striped pattern, the diffraction grating 106*b* being composed of frosted stripes A of a width (a) of about 10 microns and transparent stripes B of a width (b) of about 10 microns alternately disposed in a parallel relation with each other.

With this construction, when passing through the spectral resolution filter 106, white light is resolved into a spectrum to form a beautiful spectral pattern 107 which extends in the direction parallel to the respective stripes of the diffraction grating 106*b*.

Figure 2A:
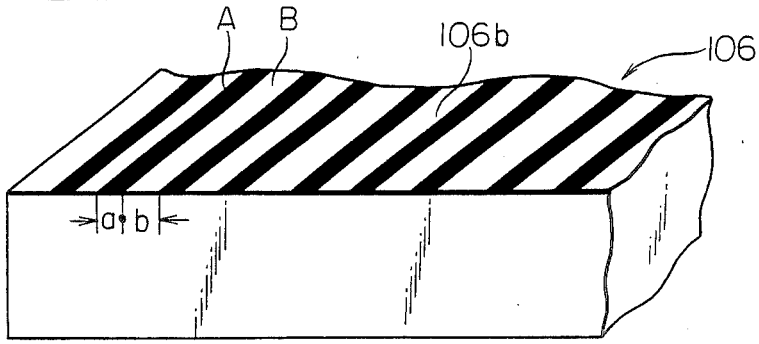
FIG. 2*a* is an enlarged perspective view showing a part of a spectral resolution filter of the present invention having a diffraction grating composed of frosted stripes and transparent stripes.
Figure 2B:
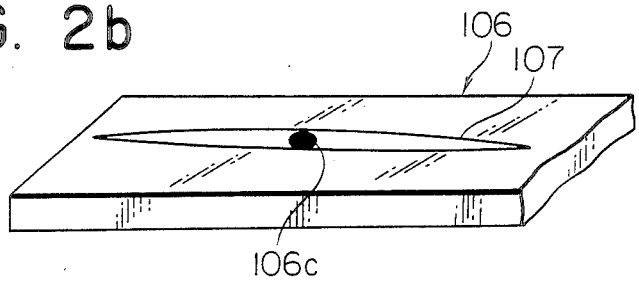
FIG. 2*b* is a perspective view showing a rectilinear stripe formed on the upper surface of the filter panel shown in FIG. 2*a;*

FIG. 2*b* shows the case in which when white light, issued from a light source (not shown) disposed below the spectral resolution filter panel 106, comes into the filter panel 106 from the lower side surface to the upper side surface thereof, it is resolved, due to a diffraction phenomenon, into a spectrum to form a rectilinear stripe 107 of spectral light on the upper surface of the filter panel 106, the rectilinear stripe 107 extending in the direction parallel to that in which stripes A and B of the diffraction grating 106*b* extend, the rectilinear stripe 107 having a particularly bright portion 106*c* at a location just above the light source.

Figure 3A:
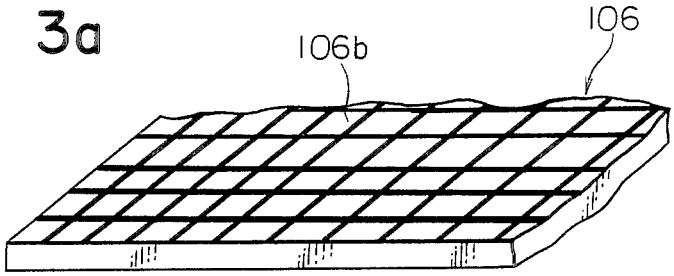
FIG. 3*a* is an enlarged perspective view similar to FIG. 2*a* showing a part of another spectral resolution filter having a diffraction grating in the form of cross stripes.
Figure 3B:
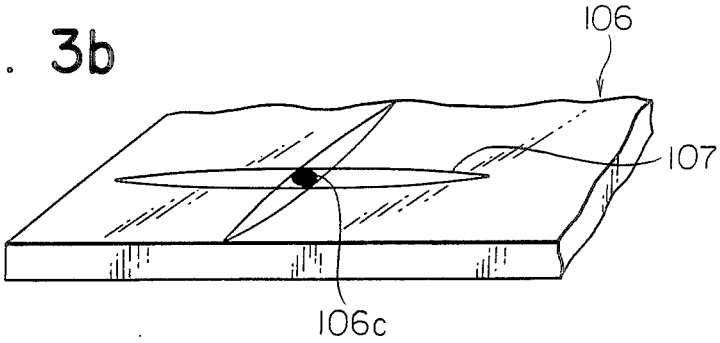
FIG. 3*b* is a perspective view similar to FIG. 2*a* showing a cross stripe formed on the upper surface of the filter panel shown in FIG. 3*a*.

FIGS. 3*a* and 3*b* are views corresponding to FIGS. 2*a* and 2*b*, respectively, and show the case in which the diffraction grating 106*b* is in the form of cross stripes. In this case, similar to the one shown in FIG. 2*b*, when white light from a light source (not shown), disposed below the spectral resolution filter panel 106, radiates upwardly to the filter panel 106 from the lower side surface to the upper side surface thereof, there will be formed on the lower side surface of the filter panel 106 a cross-shaped stripe 107 of spectral light which corresponds to a respective one of the cross stripes of the filter panel 106 and which has a particularly bright portion at its center just above the light source.

Here, it is to be noted that the above-described spectral resolution filters are well known and commercially available.

As seen from the foregoing description, according to the present invention, by illumination of the interior of the elevator car 101 through the above-described spectral resolution filters 106, the passengers in the car 101 can see the light beams emitted from the light sources 104 as spectrally resolved light sources and further the illumination of the car 101 can be greatly improved in brightness, hue and attractiveness.

Further, where the light sources 104 are in the form of point light sources such as electric lamps, the spectral light produced by the spectral resolution filter panel 106 can be seen as striped light elongated by the width of each of the point light sources so that the brightness on the surface of the car ceiling is accordingly increased, thereby reducing the number of the light sources as required and hence the costs of production.

Figure 4:
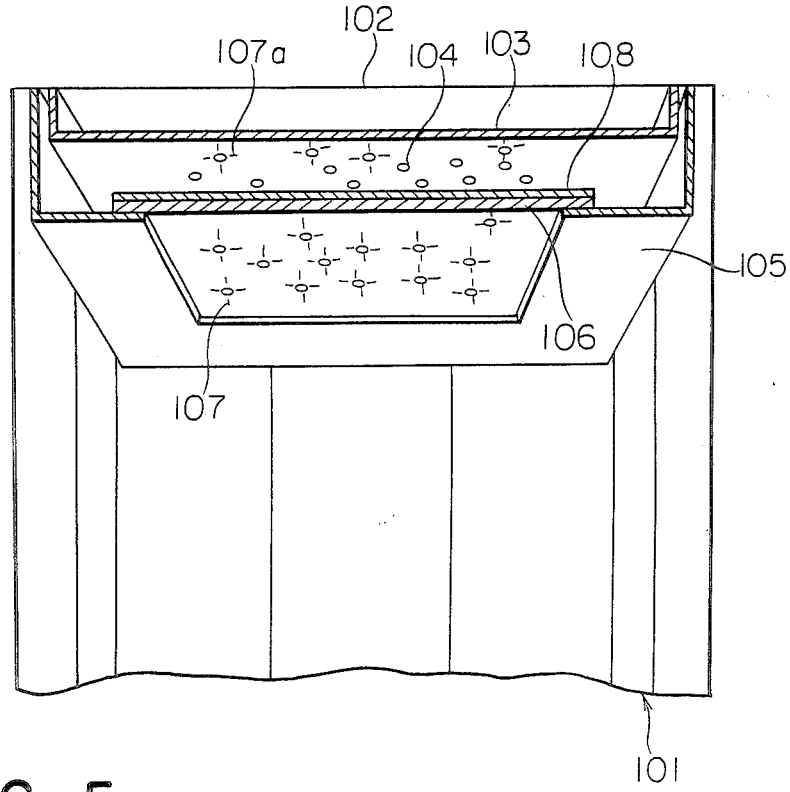
FIG. 4 is a perspective view similar to FIG. 1, showing another embodiment of the present invention.

FIG. 4 shows another embodiment of the present invention. According to this embodiment, a lighting panel 103 comprises a mirror, and a half mirror panel 108 is superposed on the upper surface of the spectral resolution filter 106. With this arrangement, light beams emitted from the light sources 104 are reflected by the lighting panel 103 in the form of a mirror and by the half mirror panel 108 so that imaginary light sources 107*a* are formed on the lighting panel 103 by the light beams which are emitted from the light sources 104 and reflected by the half mirror panel 108, and at the same time, the spectral light reflected by the spectral resolution filter panel 106 forms images on the surface of the lighting panel 103. Thus, a very splendid lighting device is provided.

Figure 5:
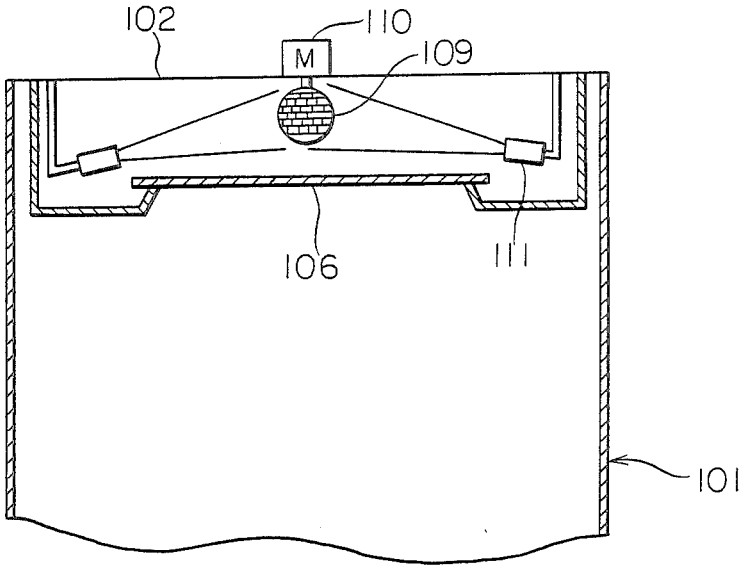
FIG. 5 is a vertically sectioned side elevational view showing the internal structure of an elevator with a lighting device in accordance with a further embodiment of the present invention.

FIG. 5 shows a further embodiment of the present invention. In this embodiment, a mirror ball 109, being rotated by a motor 110, is rotatably mounted on the ceiling panel 102 of an elevator car 101 so that the light beams from light sources 111 in the form of projectors fixedly attached to the ceiling panel 102 are reflected by the mirror ball 109 and then pass through the spectral resolution filter 106 for illumination of the interior of the elevator car 101. With this arrangement, the rotating mirror ball 109 acts as a travelling light source so as to bring about dynamic illumination effects under the combined action of the movements of the spectral lights and the superposition of the light beams from the light sources 111.

Figure 6:
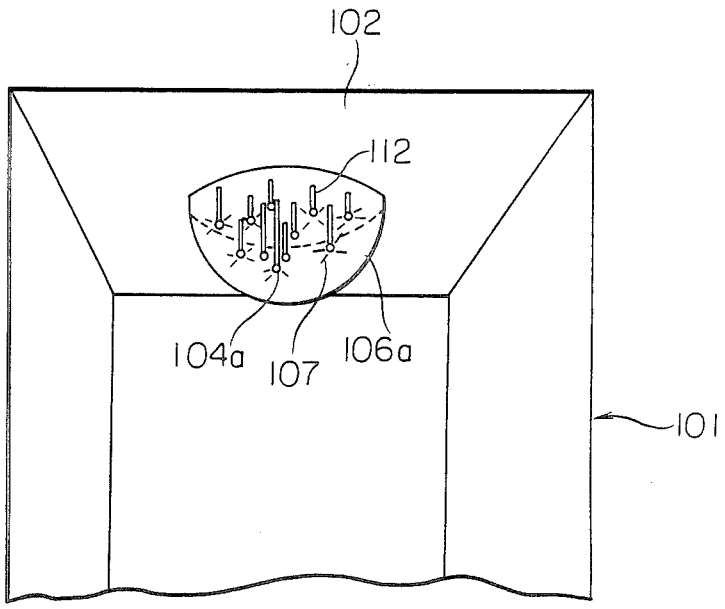
FIG. 6 is a perspective view showing an internal structure of an elevator with a lighting device in accordance with a still further embodiment of the present invention.

FIG. 6 shows a still further embodiment of the present invention. In this embodiment, a plurality of support rods 112 of varying lengths are suspended from the ceiling panel 102 of an elevator car 101, and each provided at their distal or lower end with an electric lamp 104*a* which acts as a light source. The support rods 112 and the electric lamps 104*a* are all enclosed within a semispherical spectral resolution filter 106*a* so that the passengers in the elevator car 101 can see spectral light stripes 107 from the sides thereof.

Although in the illustrated embodiments, the lighting device is installed on the ceiling of an elevator car, it may also be provided instead, on the side walls of the car and in this case, the same effects as described in the foregoing will be obtained.

As apparent from the foregoing description, a spectral resolution filter is disposed between a plurality of light sources and the interior of an elevator car so that the light beams from the light sources are spectrally resolved, thus improving the brightness, the hue and hence the attractiveness in the illumination of the elevator car interior. Accordingly, there is provided a lighting device with various decorative effects.

In addition, the area of spectral lighting resolved by the spectral resolution filter is wide so as to increase the light intensity on the entire ceiling surface of the elevator car, as a consequence of which a relatively small number of light sources can provide a bright illumination, thereby reducing the number of required component parts and hence the costs of production as well as simplifying the overall construction of the lighting device.

What is claimed is:

1. A light device for an elevator car having walls comprising a light source for emitting light toward an interior of the elevator car, and a spectral resolution filter element disposed between said light source and the interior of the car having a spectral resolution filter on a surface of said filter element facing the interior of the car transmitting the light emitted from said light source through said filter element and spectrally resolving the light into an image of spectral light with varying colors on the surface of said filter element.

2. A lighting device for an elevator car as claimed in claim 1 wherein said light source comprises a mirror ball having a multitude of reflecting surfaces formed at an outer peripheral surface, and projector means for emitting light toward said reflecting surfaces of said mirror ball.

3. A lighting device for an elevator car as claimed in claim 1 wherein said light source comprises a plurality of point light sources mounted in a dispersed pattern on a ceiling wall of the elevator car.

4. A lighting device for an elevator car as claimed in claim 1 wherein said spectral resolution filter is in a semispherical form and contains therewithin said light source.

5. A lighting device for an elevator car as claimed in claim 1 wherein said spectral resolution filter element comprises a panel having a diffraction grating in the form of a striped pattern of alternately disposed frosted and transparent stripes.

6. A lighting device for an elevator car as claimed in claim 1 wherein said spectral resolution filter element comprises a diffraction grating in the form of crossed frosted and transparent stripes on the surface thereof.

7. A lighting device for an elevator car comprising a plurality of light sources installed in the car, and a spectral resolution filter element disposed between said light sources and an interior of the car for spectrally resolving the light emitted from said light sources such that light beams from said light sources pass through said spectral resolution filter element into the car interior for illumination thereof within said light sources are mounted on a lighting panel attached to said car, said lighting panel having a mirror surface formed at its one side facing the interior of said elevator car, and wherein said spectral resolution filter is disposed in a face-to-face relation with the mirror surface of said lighting panel, said spectral resolution filter having a half mirror panel mounted on its one side surface facing the mirror surface of said lighting panel.

* * * * *